US007547113B2

(12) United States Patent
Lee

(10) Patent No.: US 7,547,113 B2
(45) Date of Patent: Jun. 16, 2009

(54) FULL-COLOR LED-BASED LIGHTING DEVICE

(75) Inventor: Wei-Chiang Lee, Albany, CA (US)

(73) Assignee: Iprset (Taiwan) Co., Ltd., Taipei (TW)

( * ) Notice: Subject to any disclaimer, the term of this patent is extended or adjusted under 35 U.S.C. 154(b) by 81 days.

(21) Appl. No.: 11/481,830

(22) Filed: Jul. 7, 2006

(65) Prior Publication Data

US 2007/0052376 A1 Mar. 8, 2007

(30) Foreign Application Priority Data

Aug. 9, 2005 (TW) ..... 94213553 U

(51) Int. Cl.
*F21V 9/00* (2006.01)
*H05B 37/00* (2006.01)

(52) U.S. Cl. ..... 362/231; 362/800; 362/236; 362/237; 362/234; 315/312; 257/88; 257/89

(58) Field of Classification Search ..... None
See application file for complete search history.

(56) References Cited

U.S. PATENT DOCUMENTS 1,345,073 A * 6/1920 Clark ..... 362/309
1,518,575 A * 12/1924 Eaton ..... 362/187
1,519,737 A * 12/1924 Lyndon ..... 362/308
2,623,692 A * 12/1952 Bedford et al. ..... 235/410
4,009,525 A * 3/1977 Hollander ..... 434/237
4,574,269 A * 3/1986 Miller ..... 362/503
4,751,506 A * 6/1988 Brown ..... 345/46
4,904,991 A * 2/1990 Jones ..... 340/815.75
6,149,283 A * 11/2000 Conway et al. ..... 362/236
6,369,525 B1 * 4/2002 Chang et al. ..... 315/300
6,827,464 B2 * 12/2004 Koren et al. ..... 362/96
2004/0263094 A1 * 12/2004 Lister ..... 315/291

FOREIGN PATENT DOCUMENTS

TW 89127119 4/2002
TW 93102287 12/2004

* cited by examiner

*Primary Examiner*—Sandra L O'Shea
*Assistant Examiner*—Danielle Allen
(74) *Attorney, Agent, or Firm*—Stout, Uxa, Buyan & Mullins, LLP

(57) ABSTRACT

A LED full-color lighting device contains a control unit, a light source unit, and a light display unit. The control unit relies on at least a potentiometer to apply various voltages to constant current sources, which in turn individually vary the current conducting through the red, green and blue LEDs of the light source unit, so as to deliver light of various colors. The colored light emitted from the light source unit can be easily and conveniently adjusted to fit a user's specific preference and mood. Colored patterns or textures can be formed on the light display unit so that the color of the light of the light source unit would mix with the colors of the patterns or textures to produce a visual effect as if some of the patterns or textures are changed.

8 Claims, 10 Drawing Sheets

FULL-COLOR LED-BASED LIGHTING DEVICE

BACKGROUND OF THE INVENTION

1. Field of the Invention

The present invention generally relates to lighting devices, and more particularly to a lighting device providing individual adjustment of the brightness of red, green, and blue light emitting diodes (LEDs) for full-color illuminating and presentation effects on the lamp shade or screen by controlling the amount of current flowing through the LEDs.

2. The Prior Arts

Currently, most of the LED-based color lamps available in the market provide various colored light by individually turning on and off the red, green, and blue LEDs of the lamp. For example, a control circuit of the lamp provides a 3-bit digital signal with each bit controlling whether to turn on (1) or off (0) the red, green, and blue LEDs, respectively. The lamp is therefore able to generate light of seven different colors, including red (001), green (010), blue (100), red plus green (011), green plus blue (110), blue plus red (101), and red plus green plus blue (111). In order to generate light of more different colors, the brightness of the individual red, green, blue LEDs has to be adjustable, instead of having only 'on' and 'off' two choices, so as to produce more color combinations. However, adjusting the brightness of LEDs by voltage is difficult due to the specific semiconductor characteristics of LEDs. It is well known that, when the LED is forward-biased, a small variation in the voltage applied would incur significantly different amount of current conducting through the LED.

Recently, some techniques for adjusting the brightness of LEDs are disclosed. For example, in the R.O.C. Patent Application No. 89127119, an analog control signal is converted to a digital signal with 256 levels. The digital signal is then applied to a pulse width modulator (PWM) whose output pulses conduct the LED periodically. As the LED is "flashed" very fast, the light from the LED is perceived as continuous and steady due to the visual persistence of human eyes. The digital signal alters the duty cycle of the pulses output by the PWM and, by increasing or decreasing the duty cycle of the pulses, the LED is able to deliver light of various brightness. However, when the brightness of the LED is reduced (i.e., low duty cycle), an observer would perceive flickers as the 1/16-second maximum duration of human visual persistence is exceeded. A lamp based on the PWM-based approach therefore can only provide stable lighting in the medium-to-high brightness range and delivers only a small number of color combinations. In another technique disclosed in R.O.C. Patent Application No. 93102287, a PWM is also used to vary the brightness of two sets of LEDs. This technique would suffer the same drawbacks of the previous one.

In addition, the aforementioned prior arts are for illumination purpose and therefore several tens of LEDs have to be adopted as the light source. Currently, the efficiency of LEDs is compatible to lamps using tungsten filament, in which around 80% of the power is converted into heat and wasted. Therefore, when a large number of LEDs are used, complicated heat dissipation mechanism has to be designed and employed, causing significant cost increase and reducing the applicability of the LED-based lamps.

SUMMARY OF THE INVENTION

Accordingly, a major objective of the present invention is to provide a LED-based lighting device in which the brightness of the LEDs can be varied continuously from complete darkness to full illumination so as to deliver light of theoretically unlimited number of colors (i.e., full-color).

Another objective of the present invention is that, in addition to the large number of possible colors, the lighting device does not rely on human visual persistence to compensate the flashes of LEDs, and therefore is able to deliver highly stable, flicker-free, and comfortable lighting no matter what the color and brightness are.

Still another objective of the present invention is to provide a low-cost, easy-to-operate, and multi-function lighting device that not only can function as an ordinary illumination device such as a desk lamp, a floor lamp, a wall lamp, etc., but, with its various colored light, also can be used to adjust a room's lighting condition so as to provide a soothing, relaxing, romantic, or even exotic atmosphere, to fit precisely the user's preference and mood.

To achieve the foregoing objectives, the lighting device of the present invention mainly contains a light source unit, a control unit, and a light display unit. The light source unit contains a number of red, green, and blue LEDs. The control unit relies on potentiometers to apply voltages of appropriate levels based on user adjustment to a number of corresponding constant current sources, respectively. The constant current sources thereby provide various amount of constant current through the red, green, and blue LEDs of the light source unit respectively. In other words, instead of using voltage or voltage pulses to control or drive the LEDs, the present invention controls the current flowing through the LEDs so as to adjust the brightness of the LEDs and thereby produces various color combinations. The stable provision of current of the constant current sources is the major factor contributing to the flicker-free and comfortable lighting of the LEDs.

Due to its capability in producing theoretically unlimited number of color combinations, the present invention can be applied for various purposes, with the light display unit playing an important role. The light display unit basically is a lamp shade or lamp screen, but it can be more versatile than that. The light display unit can be made of materials of appropriate transparency. Additionally, colored patterns or textures of appropriate transparency can be formed on the outer surface of the light display unit so that, as the color of light from the light source unit is varied, the colors of the patterns or textures would be varied as well, delivering different visual effect.

The foregoing and other objects, features, aspects and advantages of the present invention will become better understood from a careful reading of a detailed description provided herein below with appropriate reference to the accompanying drawings.

BRIEF DESCRIPTION OF THE DRAWINGS

FIG. 3 is a perspective diagram showing light beams emitted from the lighting device of FIG. 1 when it is powered on.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
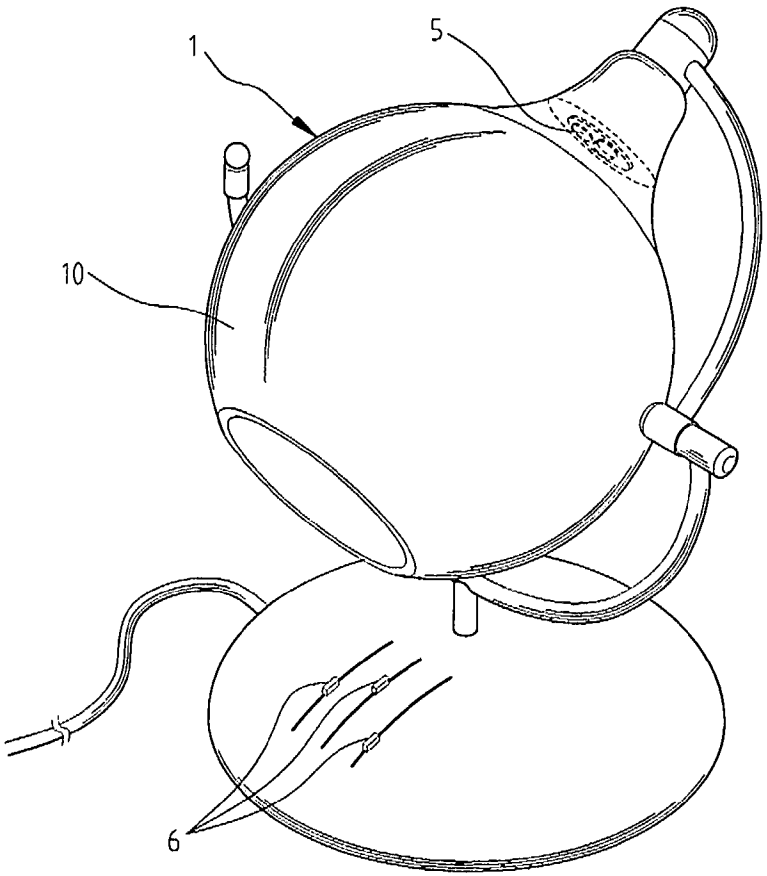
FIG. 1 is a perspective diagram showing the outlook of a lighting device according to an embodiment of the present invention.
Figure 2:
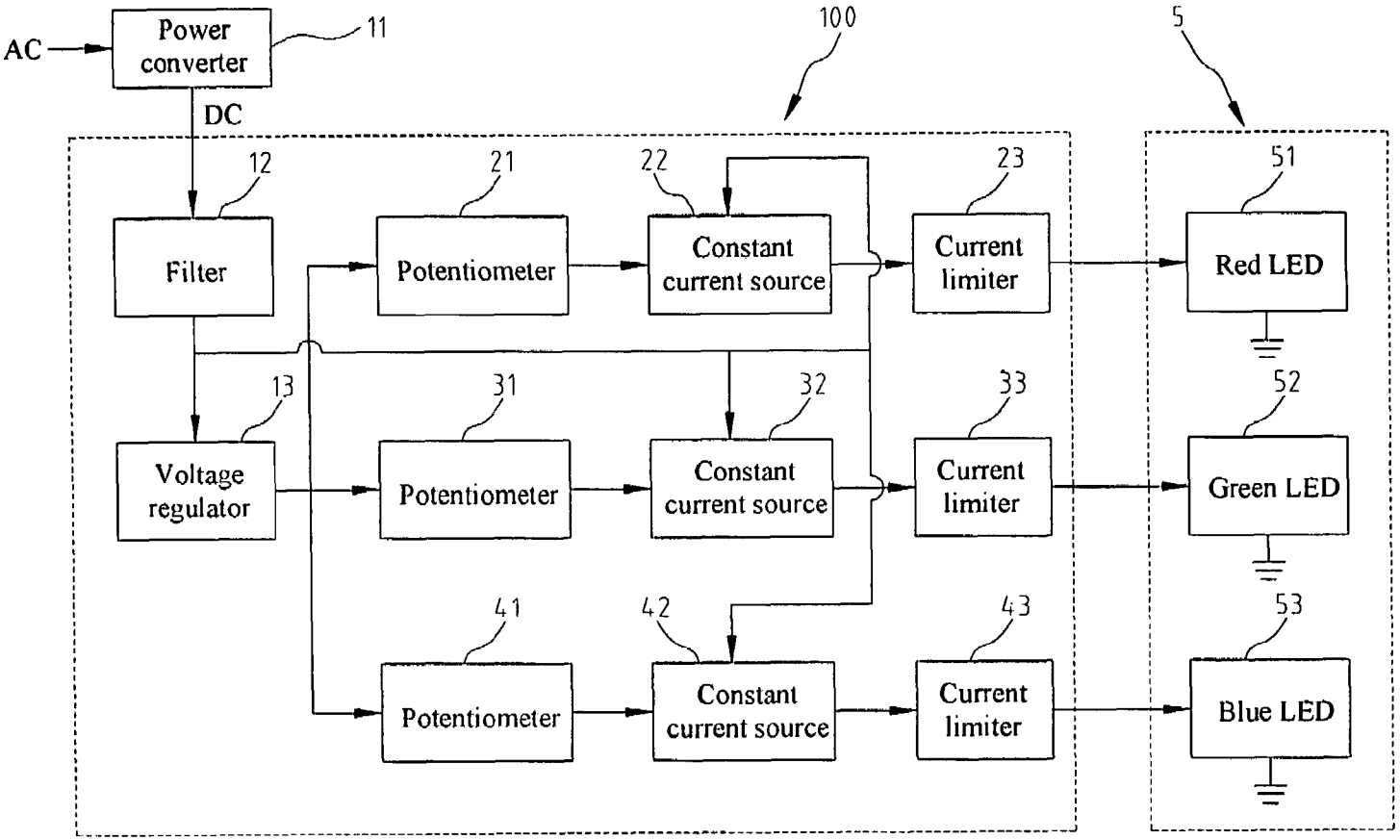
FIG. 2 is a schematic diagram showing the functional blocks of the light source unit and the control unit of the lighting device of FIG. 1.

As illustrated in FIGS. 1 and 2, an exemplary lighting device 1 according to an embodiment of the present invention as a desk lamp mainly contains a lamp shade or screen 10 (i.e., the light display unit), a set of LEDs 5 (i.e., the light source unit), and a control circuit 100 (i.e., the control unit). The lamp shade 10 is usually made of glass or plastic of an appropriate transparence or other similar materials. Colored textures or patterns also made of glass or plastic of an appropriate transparency can be formed on the outer surface of the lamp shade 10. For example, the images of red flowers and green leaves are patterned on the lamp shade 10. When the LEDs 5 are tuned to emit red light, the red flower is accentuated while the green leaves are dimmed. On the other hand, when the LEDs 5 are tuned to emit green light, the red flower is darkened while the green leaves are vividly visible. In other words, the color of the light of the LEDs 5 would mix with the colors of the patterns of the lamp shade 10 to produce a visual effect as if some of the patterns or textures are changed. The lighting device 1 also contains a set of control buttons 6, which is also part of the control unit, for adjusting the operation of the control unit. The set of LEDs 5 includes at least a red LED 51, a green LED 52 and a blue LED 53. Depending on specific requirements, other combinations of colors and numbers of LEDs can be adopted in alternative embodiments. For example, in addition to the red, green, and blue LEDs, there can be at least an additional LED of a color other than red, green, and blue.

As illustrated in FIG. 2, the control circuit 100 receives direct-current (DC) power from a power converter 11 which converts an alternate-current (AC) power (e.g., from a wall socket) into the DC power required by the control circuit 100. The DC power output from the power converter 11 is fed through a filter 12, where the ripples of the DC power are suppressed, and then through a voltage regulator 13, where the DC power is regulated to the desired voltage level and distributed to three potentiometers 21, 31 and 41. The potentiometers 21, 31, and 41 can be implemented by variable resistors or any similar means, whose output is controlled by the control buttons 6, respectively. Therefore, by adjusting the control buttons 6, the output voltage of the potentiometers 21, 31 and 41 on the three corresponding constant current sources 22, 32 and 42 can be varied. The constant current sources 22, 32 and 42 can be implemented using transistors or other similar means. Please note that the implementation details of the potentiometers and the constant current sources are omitted for simplicity as they should be quite common to people skilled in electrical circuits. Please also note that the operation of the constant current sources 22, 32, and 42 are powered by the output of the filter 12.

The output of the constant current sources 22, 32, and 42 is connected to the LEDs 51, 52, and 53, through current limiters 23, 33 and 43, respectively. As described above, the constant current sources 22, 32 and 42 receive the output voltages $V_{REG}$ from the potentiometers 21, 31 and 41, respectively, and, based on the voltages applied to them, the constant current sources 22, 32, and 42 produce an appropriate amount of current to flow through the LEDs 51, 52, and 53. According to the Ohm's law, the current flowing through each LED can be determined by the equation:

$$I_L=(V_{REG}-V_{BE})/R_L,$$

where $R_L$ is the internal resistance of the LEDs 51, 52 or 53, and $V_{BE}$ is the forward bias voltage of the transistor in the constant current source. As $V_{BE}$ and $R_L$ are constant, when the voltage output from the potentiometers 21, 31 and 41 varies, the current supplied from the constant current sources 22, 32, and 42 varies accordingly. Three current limiters 23, 33 and 43 can be incorporated between the constant current sources 22, 32, and 42 and the LEDs 51, 52, and 53, to prevent the current flowing through the LEDs 51, 52 and 53 exceeding their maximum ratings.

Figure 3:
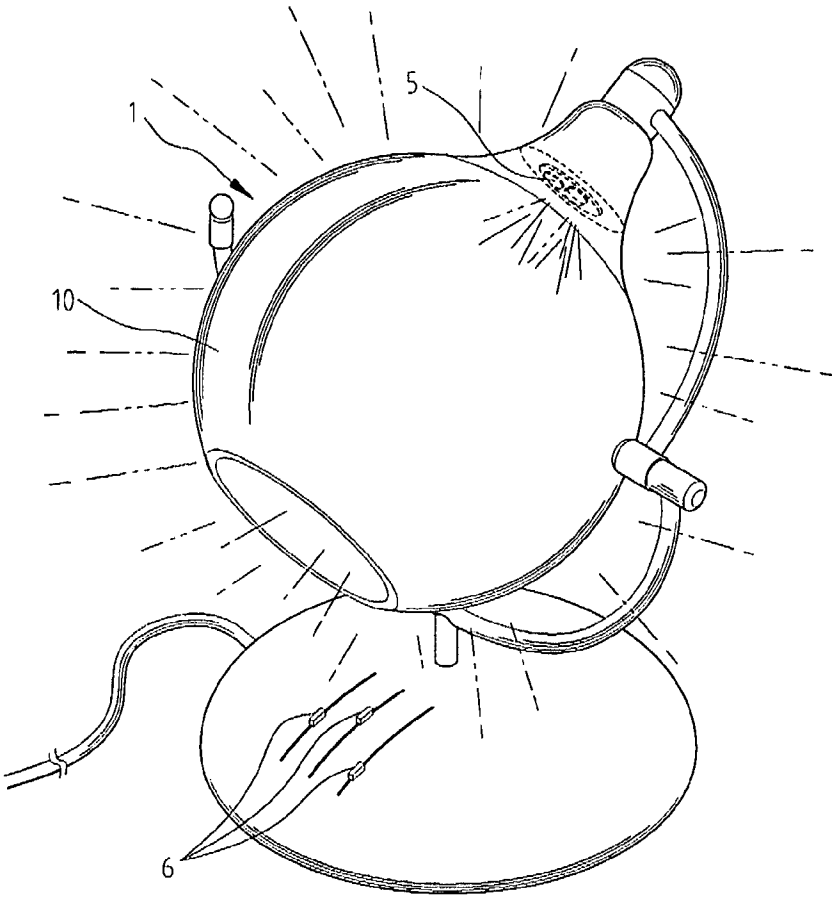
Figure 4:
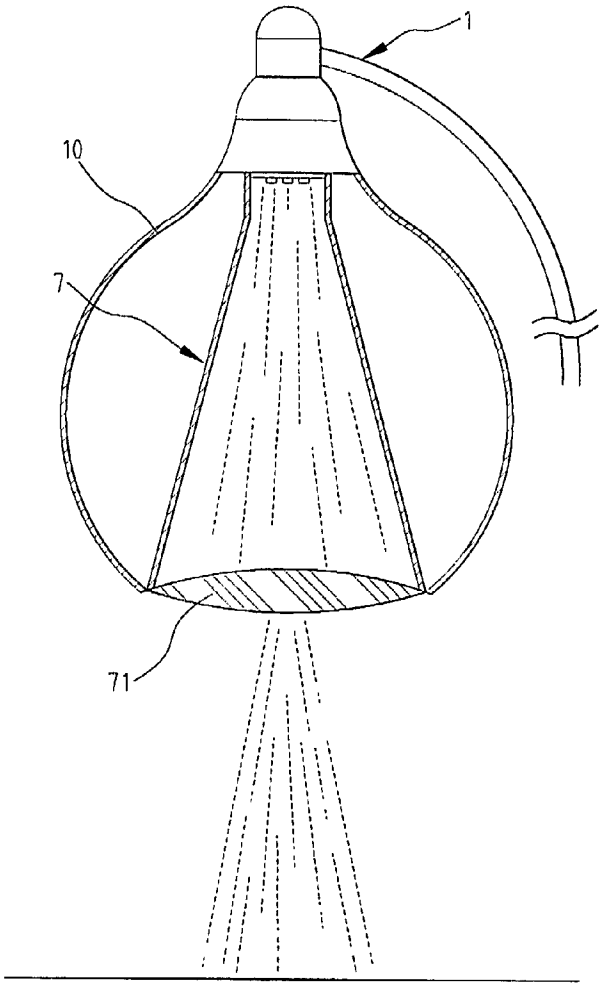
FIG. 4 is a sectional diagram showing another embodiment of the present invention where a reflector and a convex lens are detachably installed inside the light display unit.

As illustrated in FIG. 3, to obtain a desired colored light, the brightness of the red, green and blue LEDs 51, 52 and 53 are adjusted by the control buttons 6 on the lighting device 1. Thereby, the output voltages of the potentiometers 21, 31 and 41 are adjusted to vary the current flowing through the LEDs 51, 52 and 53; and, consequently, the brightness of each of the LEDs 51, 52 and 53 is adjusted to the desired level. The human eyes can thus perceive different colors from mixing the red, green and blue colored light of different brightness. As the brightness for each of red, green, and blue LEDs can be individually and linearly adjusted from complete darkness to full brightness, any colored light in the visible light spectrum can be produced by the lighting device 1. As such, a user of the present invention can easily and conveniently change a room's ornamentation and atmosphere by adjusting the light color from the lighting device 1. The room therefore can deliver a soothing and relaxing feeling at one time, a romantic or even exotic feeling at some other time, all up to the user's particular preference and mood. The light display unit or the lamp shade 10 is an important component in turning the lighting device 1 into a multi-purposed light source. For example, the lighting device 1 of FIG. 3 may function as a night lamp. On the other hand, as shown in FIG. 4, the lamp shade 10 can have a cone-shaped light reflector 7 detachably installed inside which concentrates the light beams from the LEDs into a narrower range. A lens 71, preferably a convex lens, can be installed at the mouth of the light reflector 7 so as to focus the light beams and thereby to enhance the brightness. In this embodiment, together with the adjustment of the LEDs to emit high-brightness white light, the lighting device 1 becomes a reading lamp. The present embodiment is particularly advantageous in reading in a dimly lit environment without disturbing others.

Figure 5:
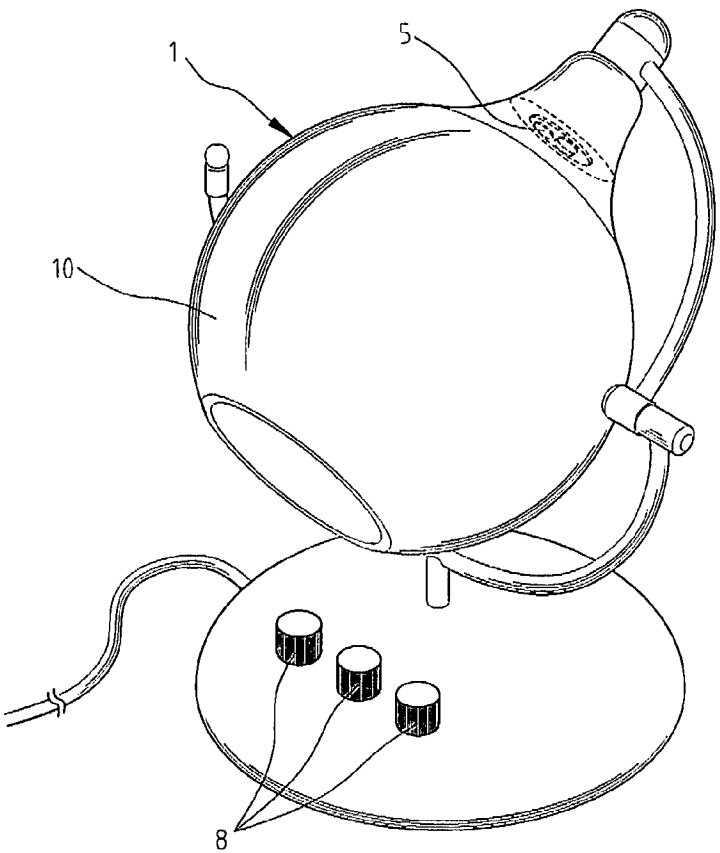
FIGS. 5 and 6 are perspective diagrams showing yet another two embodiments of the present invention.

FIG. 5 shows another embodiment of the lighting device of the present invention. As shown, the control buttons 6 can be replaced by rotational knobs 8 or other similar adjusting devices to vary the output voltages of the potentiometers 21, 31 and 41.

Figure 6:
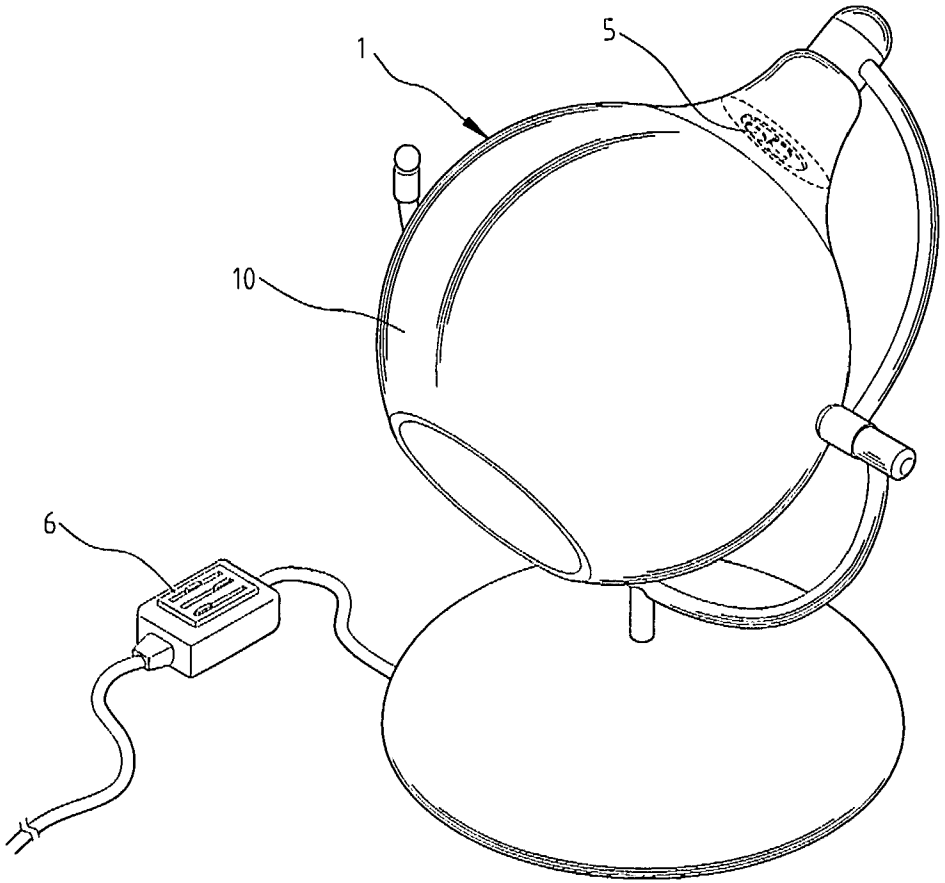

In another embodiment as shown in FIG. 6, the control buttons 6 and/or the control circuit 100 (not shown) can be arranged external to the main body of the lighting device 1 so that a designer of the lighting device 1 has the greatest degree of flexibility in designing the main body of the lighting device.

Figure 7:
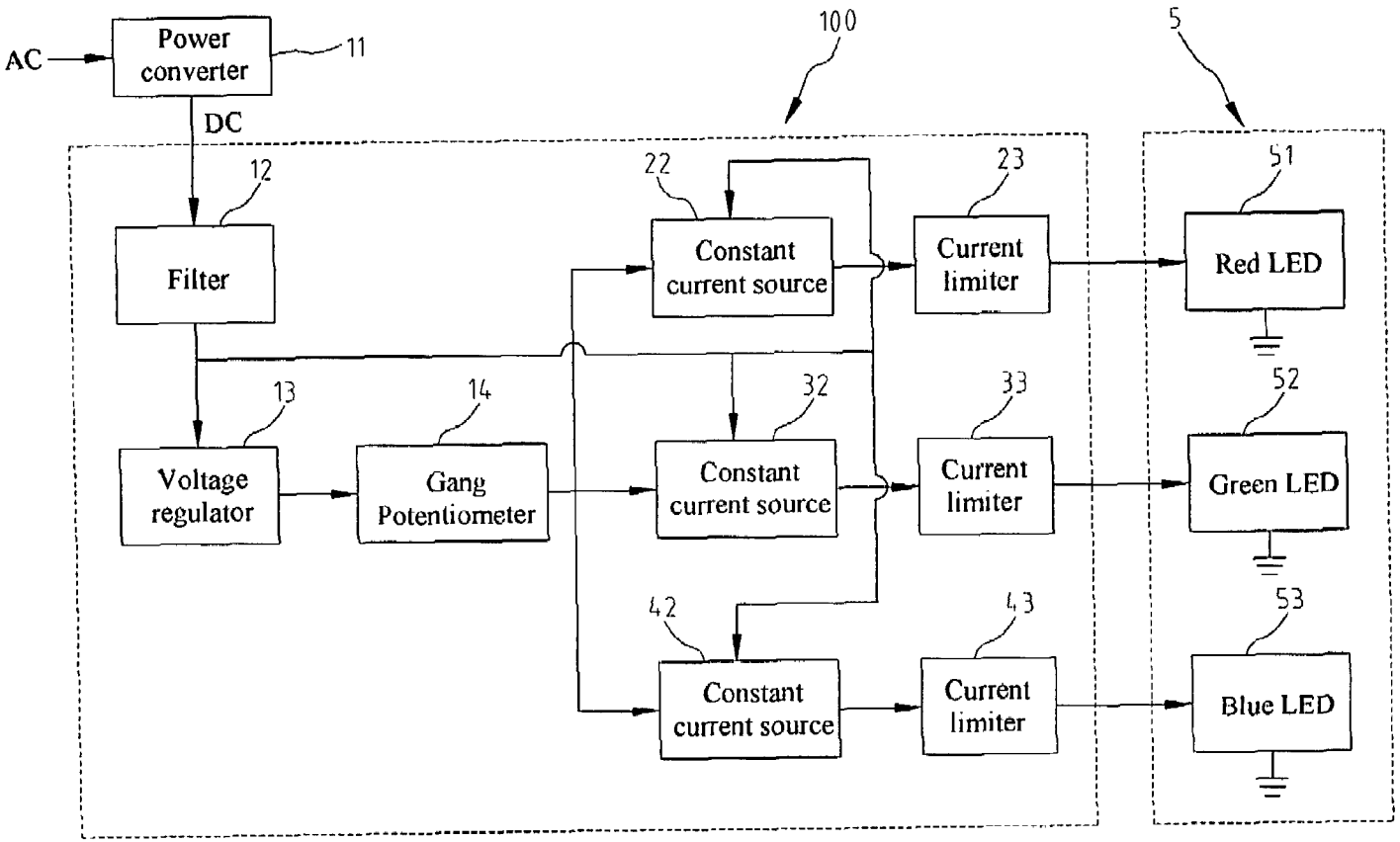
FIG. 7 is a schematic diagram showing the functional blocks of the light source unit and the control unit according to another embodiment of the present invention.
Figure 8:
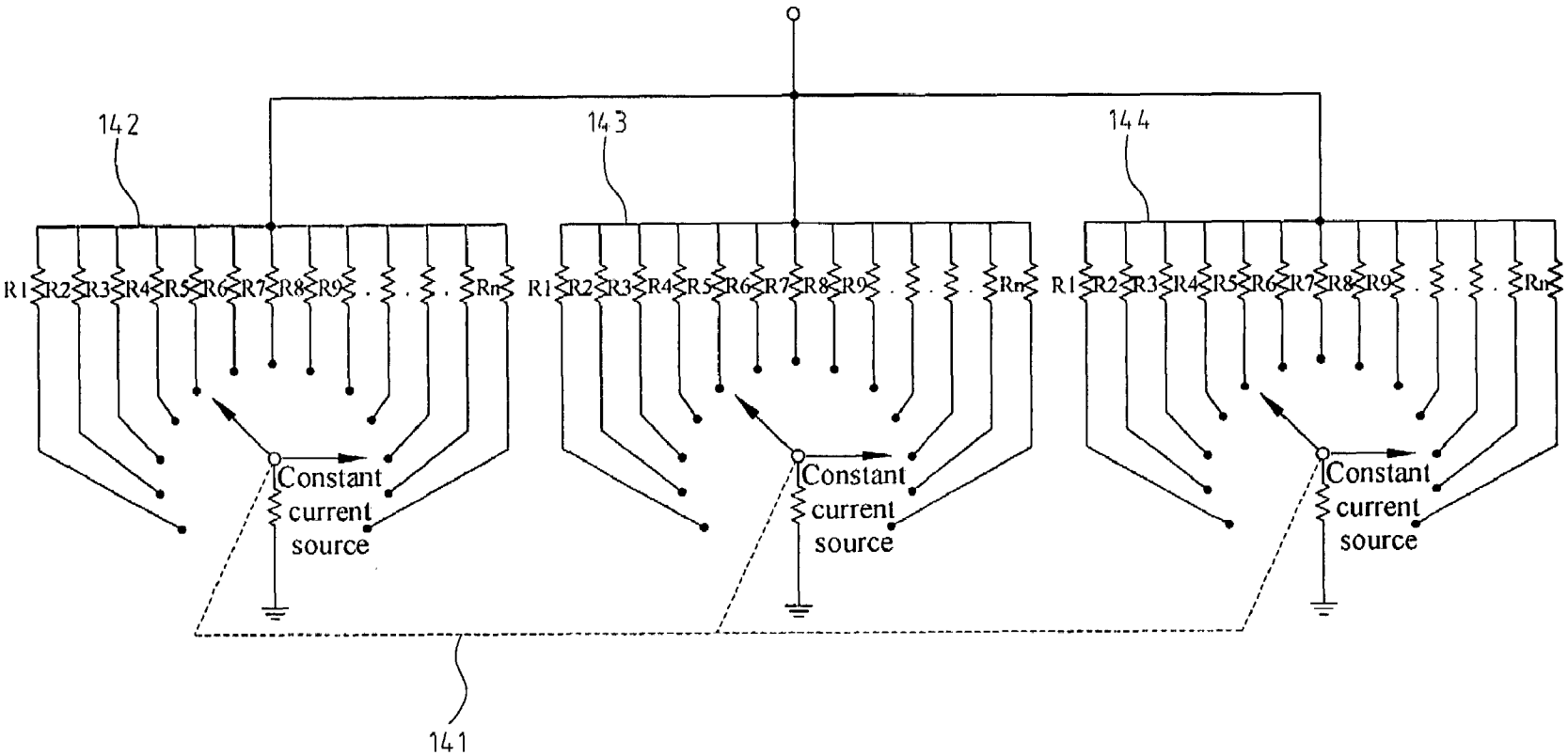
FIG. 8 is a schematic diagram showing the implementation details of the control unit of FIG. 7.

FIG. 7 is a schematic diagram showing the functional blocks of the control unit according to another embodiment of the present invention. As illustrated, a gang potentiometer 14 is adopted, instead of three separate potentiometers, in distributing voltages to the constant current sources 22, 32, and 42. The details of the gang potentiometer 14 are illustrated in FIG. 8. As shown in FIG. 8, the gang potentiometer 14 contains three arrays of resistors 142, 143, and 144, and three synchronized rotary switches 141, each of which is positioned between the three constant current sources 22, 32, and 42, and the three arrays of resistors 142, 143, and 144, respectively. Each one of the three arrays of resistors 142, 143 and 144 contains n (n>1 ) resistors R1, R2, R3, . . . , and Rn with different resistance values. The resistors R1, R2, R3, . . . , and Rn are connected in parallel with their one ends jointly connected to the output of the voltage regulator 13. On the other hand, the three rotary switches 141 are synchronized to select which one of the resistors R1, R2, R3, . . . , and Rn in the corresponding arrays 142, 143, and 143 is connected to the corresponding constant current sources 22, 32, and 42, respectively. As such, precise and stable voltages are distributed simultaneously from the voltage regulator 13 to the constant current sources 22, 32 and 42.

Figure 9:
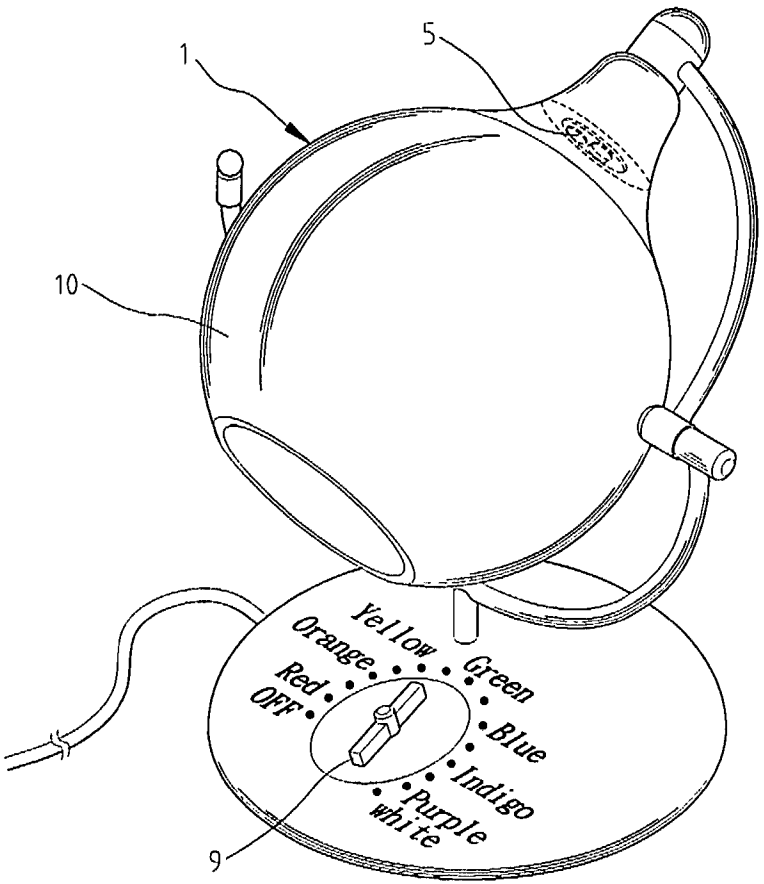
FIGS. 9 and 10 are perspective diagrams showing two additional embodiments of the present invention.

As shown in FIG. 9, the three rotary switches 141 are operated by a single knob 9 on the lighting device 1. By turning and pointing the knob 9 at the appropriate indication text around the knob 9, a specific resistor R1, R2, R3, . . . , and Rn in each of the arrays 142, 143 and 144 is selected, and appropriate voltages are applied to the constant current sources 22, 32 and 42 which, in turn, deliver appropriate amounts of current through the LEDs 51, 52, and 53, thereby generating the desired colored light. Please note that the resistance values of the resistors Rx ($1 \leqq x \leqq n$) of the arrays 142, 143 and 144 are not identical, but are carefully selected to produce the desired colored light. The present embodiment delivers pretty much the same functions of the previous embodiments but is much easier to operate.

Figure 10:
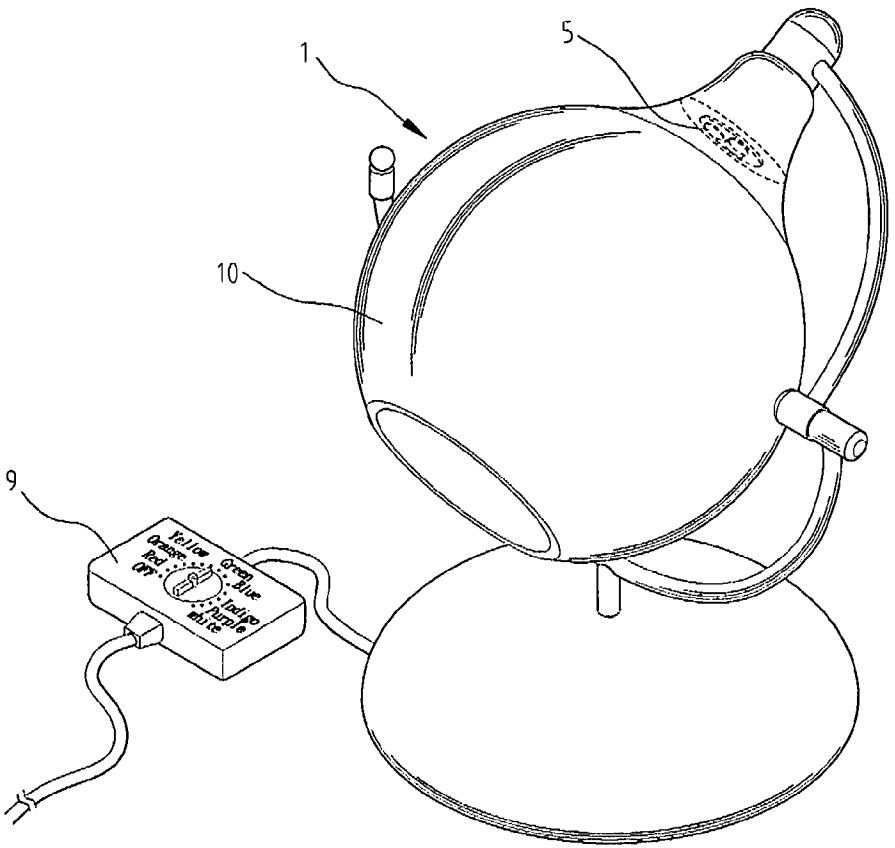

In another embodiment shown in FIG. 10, the control knob 9 and/or the control circuit 100 (not shown) can be arranged external to the main body of the lighting device 1 so that the main body of the lighting device 1 can be flexibly designed.

The LED full-color lighting device as provided has at least the following advantages, in comparison to the prior arts. Firstly, the adoption of the controllable constant current sources provides constant current through the LEDs, such that the color and brightness of the light delivered by the present invention is highly stable. The user's eyes will not be stressed as there is no human visual persistence involved and there is no flickering at all.

Secondly, the current provided by the constant current sources flowing through the LEDs is adjusted by the potentiometer. After the adjustment, the resultant current is maintained constant again. As such, the brightness of the light delivered can be smoothly and stably adjusted from complete darkness to full brightness. Therefore, the present invention can produce light of theoretically any color.

Thirdly, the control circuit of the lighting device is implemented with commercially available and low-cost components to achieve full-color illuminating and presentation effect. The lighting device can not only be used for illumination. A user of the present invention can easily and conveniently change a room's ornamentation and atmosphere by adjusting the light color from the lighting device so as to deliver a soothing, relaxing, romantic, or even exotic feeling up to the user's particular preference and mood. Colored patterns or textures can be provided on the outer surface of the light display unit 10 so that the color of the light from the light source units would mix with the colors of the patterns or textures to produce a visual effect as if some of the patterns or textures are changed.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A LED-based lighting device, comprising:

a light source unit having at least a red LED, a green LED and a blue LED;

a light display unit having an appropriate transparency as a lamp shade or lamp screen to show unlimited number and flicker-free of color lights emitted from said LEDs of said light source unit; and a control unit causing said light source unit to emit mixing color light, having at least three potentiometers, at least three constant current sources, at least three current limiters, and at least three control buttons, wherein said potentiometers, said constant current sources, said current limiters are series-connected in the foregoing order into at least three current paths respectively; each said current path is connected to said LEDs of a specific color; the outputs of said potentiometers are controlled by said control buttons respectively; wherein DC voltages derived from a power source are distributed to said potentiometers and said constant current sources; said potentiometers apply various voltages to said constant current sources based on the dynamic adjustment of said control buttons; said constant current sources thereby deliver corresponding amounts of current to said LEDs, causing said LEDs to emit light from darkness to full brightness.

2. The LED-based lighting device according to claim 1, wherein said light display unit has colored patterns or textures of an appropriate transparency on the outer surface of said light display unit; and said patterns or textures are visually changed when the colors of the light from said LEDs are mixed with the colors of said patterns or textures.

3. The LED-based lighting device according to claim 1, wherein said potentiometers are connected to said control buttons for adjusting voltage.

4. The LED-based lighting device according to claim 1, wherein said light source unit has at least an additional LED of a color other than red, green, and blue.

5. A LED-based lighting device, comprising:

a light source unit having at least a red LED, a green LED and a blue LED;

a light display unit having an appropriate transparency as a lamp shade or lamp screen to show unlimited number and flicker-free of color lights emitted from said LEDs of said light source unit; and a control unit causing said light source unit to emit mixing color light, having one gang potentiometer having at least three outputs, at least three constant current sources, at least three current limiters, and a control knob, wherein the outputs of said gang potentiometer, said constant current sources, said current limiters are series-connected in the foregoing order into at least three current paths respectively; each said current path is connected to said LEDs of a specific color; the outputs of said gang potentiometers are controlled by said control knob; wherein DC voltages derived from a power source is distributed to said gang potentiometer and said constant current sources; said gang potentiometer applies various voltages to said constant current sources based on the dynamic adjustment of said control knob; and said constant current sources thereby deliver corresponding amounts of current through said LEDs; causing said LEDs to emit light from darkness to full brightness; and wherein said gang potentiometer have at least three arrays of resistors and three synchronized rotary switches; each of said rotary switch is positioned between one of said outputs of said gang potentiometer and said three arrays of resistors, respectively; each of said three arrays of resistors has a plurality of resistors with different resistance values connected in parallel with their one ends jointly connected to the input of said gang potentiometer; and said three rotary switches are synchronized by said control knob to select which one of the said resistors in the corresponding said arrays is connected to the corresponding outputs, respectively.

6. The LED-based lighting device according to claim 5, wherein said light display unit has colored patterns or textures of an appropriate transparency on the outer surface of said light display unit; and said patterns or textures are visually changed when the colors of the light from said LEDs are mixed with the colors of said patterns or textures.

7. The LED-based lighting device according to claim 5, wherein said gang potentiometer is connected to said control knob for adjusting voltage.

8. The LED-based lighting device according to claim 5, wherein said light source unit has at least an additional LED of a color other than red, green, and blue.

* * * * *

UNITED STATES PATENT AND TRADEMARK OFFICE

CERTIFICATE OF CORRECTION

PATENT NO. : 7,547,113 B2
APPLICATION NO. : 11/481830
DATED : June 16, 2009
INVENTOR(S) : Wei-Chiang Lee It is certified that error appears in the above-identified patent and that said Letters Patent is hereby corrected as shown below:

On the Title Page, Item -73- The name of the Assignee has been corrected to read "Wei-Chiang Lee, Albany, CA (US)".

Signed and Sealed this

Fourteenth Day of July, 2009

John Doll

JOHN DOLL
*Acting Director of the United States Patent and Trademark Office*